United States Patent [19]

McClead

[11] Patent Number: 5,061,199

[45] Date of Patent: Oct. 29, 1991

[54] WALL OUTLET LOCK APPARATUS

[75] Inventor: Stephen M. McClead, Thousand Oaks, Calif.

[73] Assignee: The United States of America as represented by the Secretary of the Navy, Washington, D.C.

[21] Appl. No.: 670,136

[22] Filed: Mar. 14, 1991

[51] Int. Cl.[5] ..... H01R 13/70

[52] U.S. Cl. ..... 439/304; 200/43.02; 200/43.08; 439/346

[58] Field of Search ..... 439/133, 304, 346; 200/43.02, 43.04, 43.05, 43.07, 43.08, 43.09, 43.11, 43.12

[56] References Cited

U.S. PATENT DOCUMENTS

| | | | |
|---|---|---|---|
| 2,643,787 | 6/1953 | Rockman | 439/133 |
| 2,709,198 | 5/1955 | Holtshouser | 439/133 |
| 2,891,102 | 6/1959 | Grimes | 439/133 |
| 3,293,588 | 12/1966 | Blonder | 439/133 |
| 3,775,726 | 11/1973 | Gress | 439/346 |
| 4,063,110 | 12/1977 | Glick | 200/43.02 |
| 4,162,516 | 7/1979 | Becker | 439/133 |
| 4,479,688 | 10/1984 | Jennings | 439/133 |
| 4,603,931 | 8/1986 | Ruffman | 439/133 |
| 4,674,813 | 6/1987 | Feldner | 439/304 |

*Primary Examiner*—Neil Abrams
*Attorney, Agent, or Firm*—David S. Kalmbaugh

[57] ABSTRACT

A wall outlet lock apparatus for retaining an electrical appliance plug at an electrical outlet comprising at least one electrical plug receptacle for receiving the appliance plug; electrical switching means connected to the electrical plug receptacle for transferring electrical power from the wall outlet to the electrical plug receptacle and for disengaging the wall outlet from the electrical plug receptacle to prevent transfer of electrical power from the wall outlet to the electrical plug receptacle; means for securing the wall outlet lock apparatus to the wall outlet and locking means for preventing the unauthorized removal of the electrical appliance plug from the wall outlet lock apparatus.

8 Claims, 3 Drawing Sheets

WALL OUTLET LOCK APPARATUS

BACKGROUND OF THE INVENTION

1. Field of the Invention

This invention relates generally to a wall outlet lock apparatus and, more specifically, to an apparatus which is electrically coupled to an electrical wall outlet and which includes first means for securely and safely locking electrical appliance plugs into plug receptacles and second means for prohibiting power from reaching the plug receptacle and hence preventing the appliance from being used.

2. Description of the Prior Art

In the past, there has been disclosed a number of inventions which attempt to secure electrical appliance plugs in electrical wall outlets.

U.S. Pat. No. 3,159,446 to Protzmann discloses a pilfer proof wall plate. The wall plate replaces any common duplex receptacle cover plate, and prevents an appliance plug from being removed permitting theft of the appliance. In addition, there is provided no means for preventing the appliance from being used, as power cannot be prevented from reaching the appliance.

U.S. Pat. No. 3,067,402 to Thaw discloses a safety shield and electrical plug lock for securing a male plug of a female wall outlet. A plug cap is secured to the shield by screws and thus prevents the plug from being pulled from the socket. However, the screws are easily removed permitting theft of the appliance. Further, there is no means for preventing the appliance from being used, as power cannot be prevented from reaching the appliance.

Various other inventions have been disclosed with their objective being to prevent easy removal of appliance plugs from wall sockets. In addition, numerous inventions have been disclosed which prevent access to the sockets so as to prevent injuries to unwary parties. See, for example, U.S. Pat. No. 2,987,690 to Marbars, U.S. Pat. No. 2,891,102 to Gumes and U.S. Pat. No. 4,478,688 to Jennings.

Accordingly, there is a need to provide an improved wall outlet lock apparatus which would not only prevent undesired removal of appliance plugs but would also provide a means for preventing electrical power from reaching the appliance thereby prohibiting unauthorized use of the appliance.

SUMMARY OF THE INVENTION

It is an object of the present invention to provide an improved and inexpensive wall outlet lock apparatus.

It is another object of the present invention to provide an improved wall outlet lock apparatus which prohibits undesired removal of electrical appliances by preventing the appliance plug from being removed from the wall outlet lock apparatus.

It is still another object of the present invention to provide an improved wall outlet lock apparatus which includes means for preventing the undesired removal of the wall outlet lock apparatus from an electrical wall outlet.

It is yet another object of the present invention to provide an improved wall outlet lock apparatus which prevents the unauthorized use of an appliance by preventing electrical power from reaching the appliance.

A further object of the present invention is to provide an improved wall outlet lock apparatus which permits easy removal of appliance plugs from the wall outlet lock apparatus by an authorized individual.

The above and other objects of the present invention are achieved by a wall outlet lock apparatus for retaining an electrical appliance plug at an electrical outlet comprising at least one electrical plug receptacle for receiving the appliance plug; electrical switching means connected to the electrical plug receptacle for transferring electrical power from the wall outlet to the electrical plug receptacle and for disengaging the wall outlet from the electrical plug receptacle to prevent transfer of electrical power from the wall outlet to the electrical plug receptacle; means for securing the wall outlet lock apparatus to the wall outlet and locking means for preventing the unauthorized removal of the electrical appliance plug from the wall outlet lock apparatus.

The foregoing and other objects, features and advantages of this invention will be apparent from the following more particular description of the preferred embodiment of the present inventions illustrated in the accompanying drawings.

DETAILED DESCRIPTION OF THE PREFERRED EMBODIMENT

Figure 1:
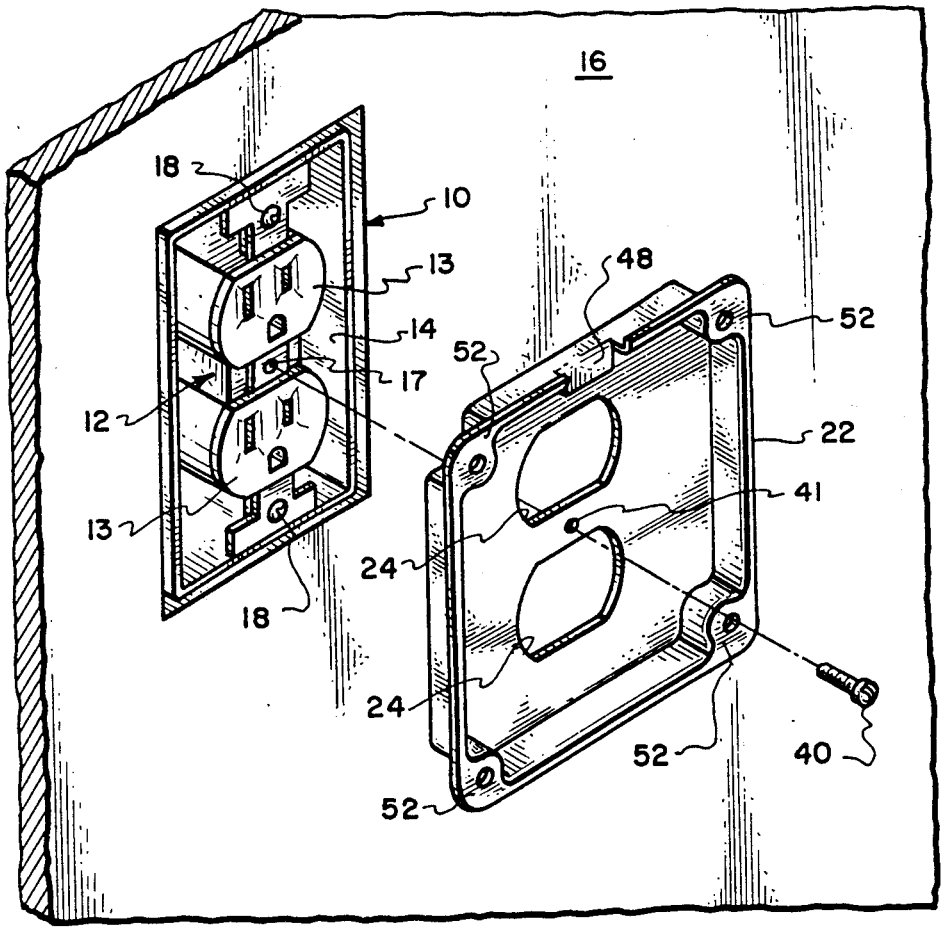
FIG. 1 is a front perspective view of the removable face wall plate of the present invention.

Referring now to FIG. 1, there is shown a conventional dual socket AC wall electrical power outlet 10 consisting of an electrical receptacle unit 12 which has a pair of 120 volt electrical plug outlets 13 and is mounted within a junction box 14 in a wall 16. The receptacle unit 12 is mounted by means of screws 18 to mounting tabs, not illustrated, which are integral to the junction box. Both the junction box 14 and the receptacle unit 12 are standard commercially available items which need not be described further. The junction box is usually a metallic box which is electrically grounded through the armored metallic conduit used in such systems.

Referring to FIGS. 1 thru 4, the wall outlet lock apparatus 19 of the present invention includes a rectangular shaped metal housing 20, which has a removable face wall plate 22 in which are formed two plug openings 24 through which an electrical inlet power plug 25 may be inserted into either one of the plug outlets 13 of receptacle unit 12. The rectangular shaped metal housing 20 further comprises four side walls 26, 27, 28 and 29 and a front wall/plate 30. Front plate 30 has formed therein two plug openings 31 through which an electrical appliance plug 32 may be inserted into either one of a pair of 120 volt electrical plug outlets 33 of an electrical receptacle unit 34. Receptacle unit 34 is mounted to housing 20 by means of a pair of screws, not illustrated, which threadably engage first and second L shaped support brackets 36 and 38 affixed to housing 20 by means of for instance welds or screws. The housing 20 which may be a commercially available metallic box is mounted to the wall outlet by means of a screw 40 passing through a screw hole 41 in plate 22 and threaded into a face plate screw hole 17 in outlet 10.

Figure 4:
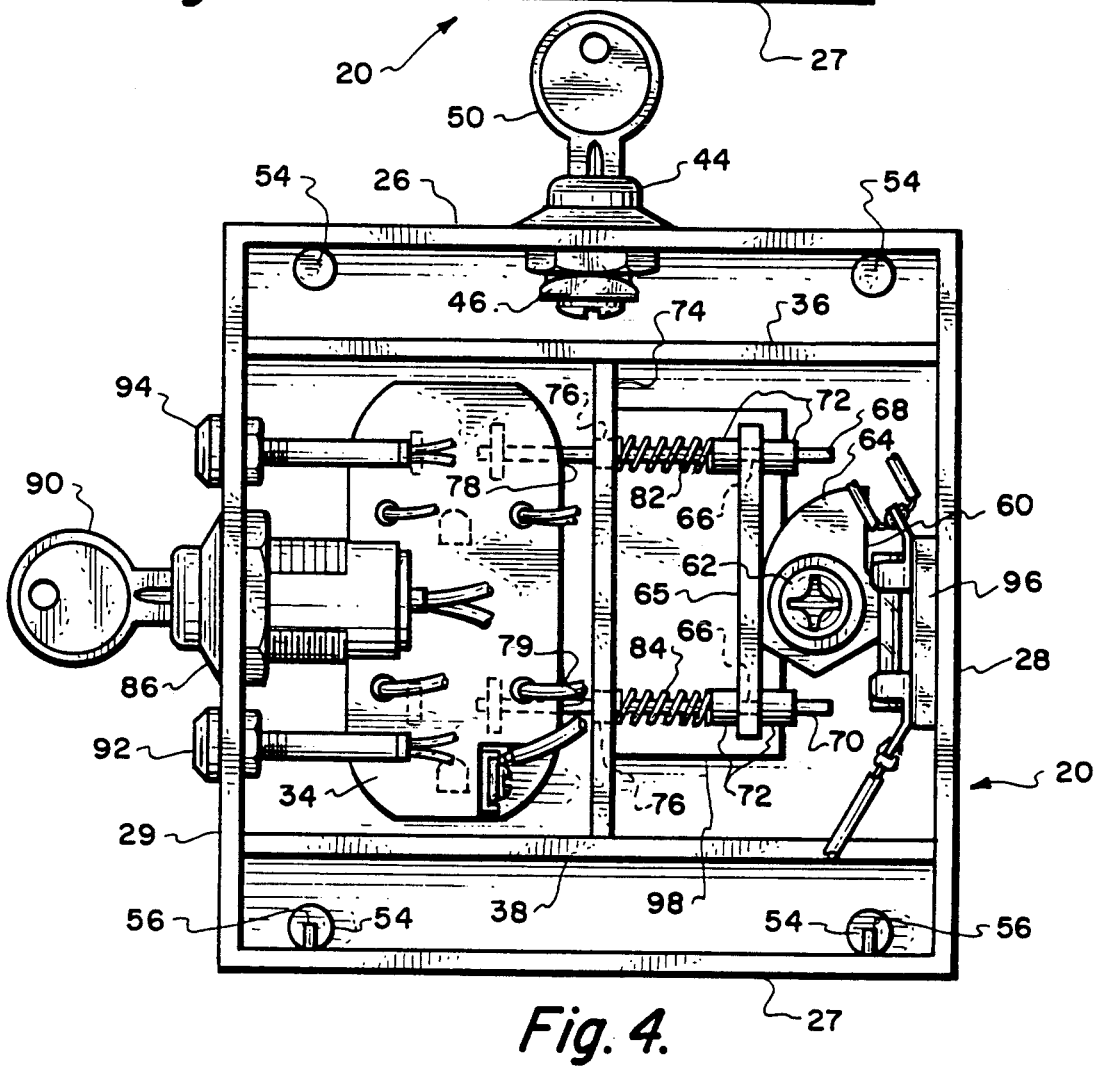
FIG. 4 is a rear view illustrating the present invention with the face wall plate removed.
Figure 5:
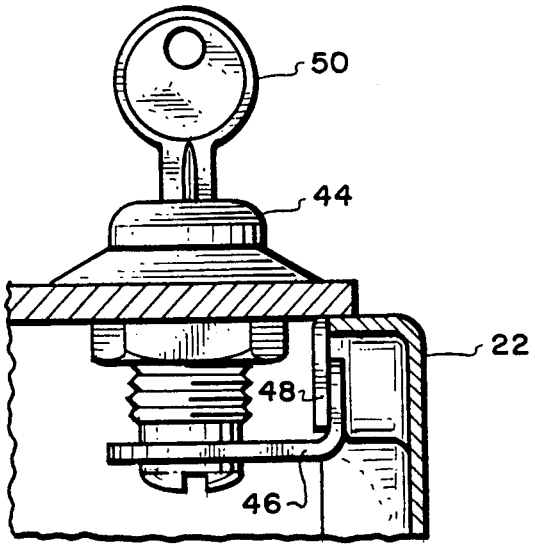
FIG. 5 is a view in section illustrating the first lock key mechanism used to secure the rectangular shaped metal housing to the removable face wall plate.

Referring now to FIGS. 4 and 5, plate 22 is secured to housing 20 by a first key lock mechanism 44 mounted in the upper side wall 26. First key lock mechanism 44 includes a locking lever 46 which engages a tab 48 on the upper edge of plate 22 when rotated by a key 50 inserted in key lock mechanism 44. Plate 22 also has in each corner thereof a depression forming a flange 52 with each corner flange 52 of plate 22 resting on a support post 54 located at each corner of housing 20. A pair of protrusions 56 extending from wall 27 of housing 20 engage the corner flanges 52 on the lower edge of plate 22 thereby preventing the removal of plate 22 from housing 20 when locking lever 46 of key lock mechanism 44 is in engagement with tab 48 of plate 22.

Figure 2:
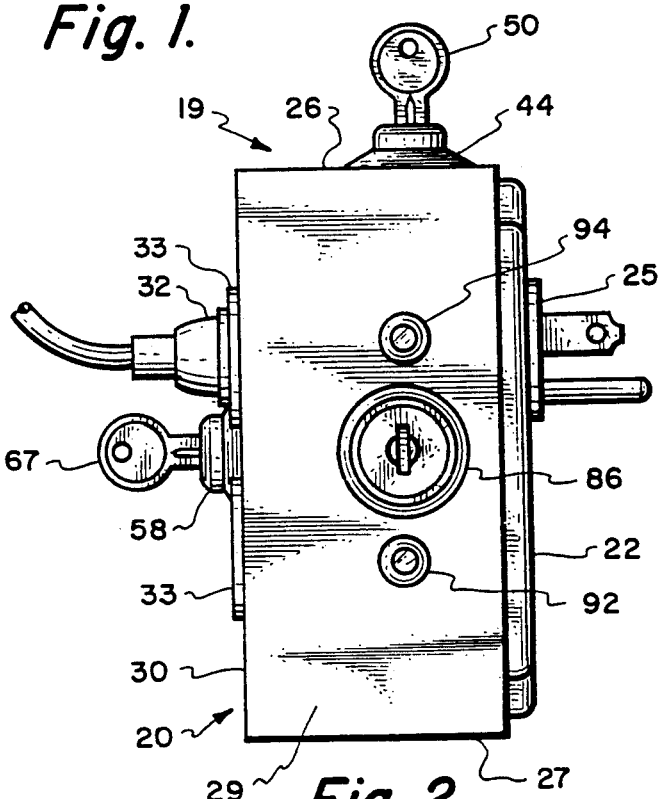
FIG. 2 is a side view of the wall outlet lock apparatus of the present invention.
Figure 3:
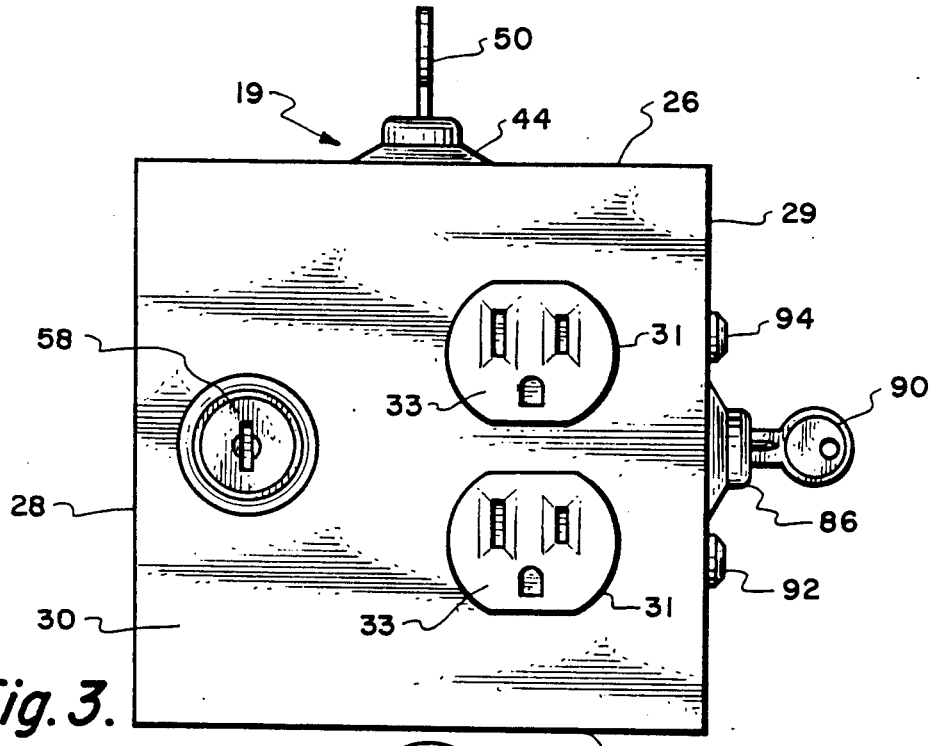
FIG. 3 is a front view of the wall outlet lock apparatus of the present invention.

Referring to FIGS. 2 and 4, a second key lock mechanism 58 mounted in the front plate 30 of housing 20 has a cam 60 affixed thereto by a screw 62. Cam 60 has a curved portion 64 which engages one face of a rectangular shaped plate 65 moving plate 65 from right to left when cam 60 is rotated in a counter-clockwise direction by an operator inserting a key 67 in mechanism 58 and then turning key 67 to a locked position. Plate 65 has therein two apertures 66, with each aperture 66 having one of two parallel locking rods 68 and 70 passing therethrough. Each locking rod 68 and 70 is, in turn, held in a fixed position with respect to plate 65 by a pair of retaining rings 72 positioned on either side of each aperture 66.

Figure 6:
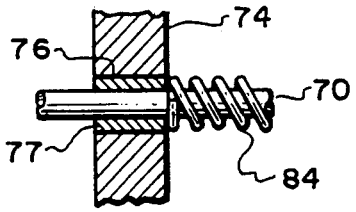
FIG. 6 is a view in section illustrating one of the two locking rods of the present invention in slidable engagement with a sleeve within rectangular shaped support plate.
Figure 7:
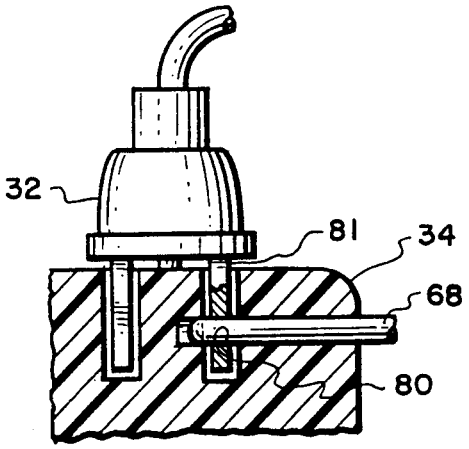
FIG. 7 is a view in section illustrating one of the two locking rods of the present invention in engagement with an electrical prong of an appliance plug.

A rectangular shaped support plate 74 is positioned parallel to plate 65, perpendicular to and between L shaped support brackets 36 and 38 and is attached to support brackets 36 and 38 by means of welds, not shown. Plate 74, in turn, has a pair of apertures 76 with each aperture 76 having a plastic sleeve 77 inserted therein as is best illustrated in FIG. 6. Each rod 68 and 70 is, in turn, supported by and in slidable engagement with one of the two sleeves 77. Rotation of cam 60 in the counter-clockwise direction extends locking rods 68 and 70 respectively through apertures 78 and 79 in electrical receptacle unit 34. Locking rod 68, in turn, engages an aperture 80 within electrical prong 81 of appliance plug 32, which retains appliance plug 32 within the upper electrical plug outlet 33 of electrical receptacle unit 34 as is best illustrated in FIG. 7. It should be noted that locking rod 70 would also retain an appliance plug within the lower electrical plug outlet 33 of electrical receptacle unit 34.

A pair of springs 82 and 84 respectively positioned around locking rods 68 and 70 and between plate 74 and plate 65 expand moving plate 65 from left to right when cam 60 is rotated clockwise thereby releasing appliance plug 32 from electrical plug outlet 33 of electrical receptacle unit 34.

Figure 8:
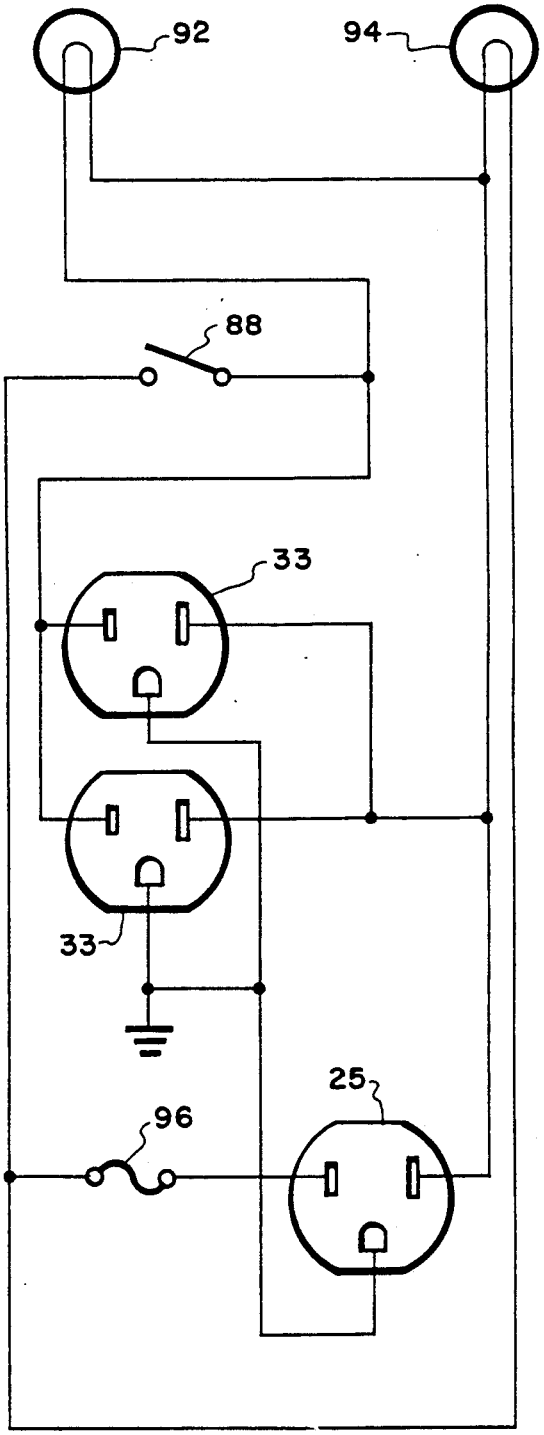
FIG. 8 is an electrical schematic diagram of the present invention.

Referring now to FIGS. 2, 4 and 8, there is shown a third key lock mechanism 86 which includes an electrical switch 88. Electrical switch 88 when closed by a key 90 inserted into key lock mechanism 86 electrically couples electrical inlet power plug 25 to electrical receptacle unit 34, thereby allowing power to be transferred from 120 volt electrical plug outlet 13, FIG. 1, through electrical inlet power plug 25 to the 120 volt electrical plug outlets 33 of electrical receptacle unit 34. It should also be noted that closure of electrical switch 88 allows electrical current to flow through a green indicator light 92 indicating that electrical power is being provided to the 120 volt electrical plug outlets 33 of electrical receptacle unit 34.

Similarly, when electrical switch 88 is open electrical current flows through a red indicator light 94 indicating that electrical power is not being provided to the 120 volt electrical plug outlets 33 of electrical receptacle unit 34. There is also included between electrical inlet power plug 25 and the 120 volt electrical plug outlets 33 of electrical receptacle unit 34 a fuse 96 which protects an appliance, not illustrated, from a current surge.

In the preferred embodiment of the present invention the fuse 96 used was a 15 amp fuse. It should be noted that plate 65 and sleeves 77 were fabricated from non-conductive materials such as plastic and fiberboard in order to prevent electrical shock to the user of the wall outlet lock apparatus 19. It should also be noted that there is positioned below plate 65 a rectangular shaped fiberboard 98 upon which plate 65 rest and which retains plate 65 in a plane parallel to plate 74 when plate 74 is engaged by the curved surface 64 of cam 60. Further, it should be noted that one key may be utilized with and adapted to fit key lock mechanisms 44, 58 and 86, or that each key may be different, that is, only key 50 will fit key lock mechanism 44, only key 67 will fit key lock mechanism 58, and only key 90 will fit key lock mechanism 86. In addition, each key 50, 67 and 90 may be removed from its associated lock mechanism 44, 58 and 86 when the key lock mechanism is in the unlocked position or the locked position.

Further, it should be noted that one key may be adapted to fit each key lock mechanism 44, 58 and 86, or each key may be different, that is only key 50 will fit key lock mechanism 44, only key 67 will fit key lock mechanism 58 and only key 90 will fit key lock mechanism 86. In addition, each key 50, 67 and 90 may be removed from its associate key lock mechanism 44, 58 and 86 when the key lock mechanism is in the locked or unlocked positioned.

While the invention has been particularly described and shown with reference to the preferred embodiments thereof, it will be understood to those skilled in the art that various changes in form and detail may be made therein without departing from the spirit and scope of the invention which is limited only by the appended claims.

What is claimed is:

1. A wall outlet lock apparatus for retaining an electrical appliance plug at an electrical wall outlet comprising:

a rectangular shaped housing having a removable face wall plate and a front plate;

means for securing said face wall plate over said electrical wall outlet;

a master electrical plug operably disposed within said rectangular shaped housing, said master electrical plug having at least a pair of plug prongs operably disposed through the removable face wall plate for mechanically and electrically engaging said electrical wall outlet;

an electrical receptacle unit mounted on the front plate of said housing, said electrical receptacle unit having at least one electrical plug outlet for removably receiving at least one electrical appliance plug;

first key operated locking means operably disposed within said rectangular shaped housing and having an electrical switch electrically coupled between said master electrical plug and said electrical receptacle unit;

said first key operated locking means being adapted to selectively close said electrical switch to complete an electrical circuit between said master electrical plug and said at least one electrical plug outlet and to selectively open said electrical switch and thereby break the circuit between said master electrical plug and said at least one electrical plug outlet so as to selectively electrically energize and deenergize said at least one electrical plug outlet to selectively allow for or prevent the transfer of electrical power between said master electrical plug and said at least one electrical plug outlet;

first light means mounted on said rectangular shaped housing for indicating that said electrical switch is closed and electrical power is being provided to said at least one electrical plug outlet;

second light means mounted on said rectangular housing shaped housing for indicating that said electrical switch is open and electrical power is not being provided to said at least one electrical plug outlet;

second key operated locking means operably disposed within said rectangular shaped housing for fastening said removable face wall plate to said rectangular shaped housing so as to prevent the removal of said wall outlet lock apparatus from said electrical wall outlet;

engaging means operably disposed within said rectangular shaped housing for securing said electrical appliance plug to said at least one electrical plug outlet and thereby preventing the unauthorized removal of said electrical appliance plug from said at least one electrical plug outlet; and third key operated locking means operably disposed within said rectangular shaped housing, said third key operated locking means being operatively coupled to said engaging means so as to effectuate the securing of said electrical appliance plug to said at least one electrical plug outlet when said third key operated locking means is in a locked position and to allow for the removal of said electrical appliance plug from said at least one electrical plug outlet when said third key operated locking means is in an unlocked position.

2. The wall outlet lock apparatus of claim 1 wherein said means for securing said face wall plate over said electrical wall outlet comprises at least one metallic screw.

3. The wall outlet lock apparatus of claim 1 wherein said first light means comprises a green indicator light.

4. The wall outlet lock apparatus of claim 1 wherein said second light means comprises a red indicator light.

5. A wall outlet lock apparatus for retaining an electrical appliance plug at an electrical wall outlet comprising:

a rectangular shaped housing having a removable face wall plate and a front plate, said face wall plate having a locking tab on one edge thereof;

means for securing said face wall plate over said electrical wall outlet;

a master electrical plug operably disposed within said rectangular shaped housing, said master electrical plug having at least a pair of plug prongs operably disposed through the removable face wall plate for mechanically and electrically engaging said electrical wall outlet;

an electrical receptacle unit mounted on the front plate of said housing, said electrical receptacle unit having at least one electrical plug outlet for removably receiving at least one electrical appliance plug;

said electrical appliance plug having a pair of plug prongs, each plug prong having an aperture therein;

first key operated locking means operably disposed within said rectangular shaped housing and having an electrical switch electrically coupled between said master electrical plug and said electrical receptacle unit;

said first key operated locking means being adapted to selectively close said electrical switch to complete an electrical circuit between said master electrical plug and said at least one electrical plug outlet and to selectively open said electrical switch and thereby break the circuit between said master electrical plug and said at least one electrical plug outlet so as to selectively electrically energize and deenergize said at least one electrical plug outlet to selectively allow for or prevent the transfer of electrical power between said master electrical plug and said at least one electrical plug outlet;

a first indicator light mounted on said rectangular shaped housing, said first indicator light being electrically coupled between said electrical switch and said at least one electrical plug outlet such that when said electrical switch is closed said first indicator light is on indicating electrical power is being supplied to said at least one electrical plug outlet;

a second indicator light mounted on said rectangular shaped housing, said second indicator light being electrically coupled between said master electrical plug and said at least one electrical plug outlet such that when said electrical switch is open said second indicator light is on indicating electrical power is not being supplied to said at least one electrical plug outlet;

second key operated locking means operably disposed within said rectangular shaped housing for fastening said removable face wall plate to said rectangular shaped housing;

said second key operated locking having a locking lever rotatably connected thereto such that when said second key locking means is in a locked position said locking lever is in engagement with said locking tab thereby preventing the removal of said wall outlet lock apparatus from said electrical wall outlet;

a rectangular shaped plate slidably positioned within said rectangular shaped housing, said rectangular shaped plate having at least one locking rod extending therefrom to an aperture within said electrical receptacle unit;

a rectangular shaped support plate fixedly mounted within said housing approximately parallel to said rectangular shaped plate, said rectangular shaped support plate having at least one aperture therein, said at least one locking rod being in slidable engagement with the at least one aperture in said support plate;

third key operated locking means operably disposed within said rectangular shaped housing, said third key operated locking means having a cam rotatably connected thereto, said cam having a curved portion which is in engagement with one face of said rectangular shaped plate such that when said third key operated locking means is in a locked positioned said at least one locking rod is extended through the at least one aperture in said electrical receptacle unit into the aperture in one of said prongs of said electrical appliance plug so as to effectuate the securing of said electrical appliance plug to said at least one electrical plug outlet; and spring means positioned between said rectangular shaped plate and said rectangular shaped support plate for expanding said rectangular shaped plate away from said rectangular shaped support plate such that when said third key operated locking means is in an unlocked position said at least one locking rod is withdrawn from the apertures of said prongs of said electrical appliance plug so as to allow for the removal of said electrical appliance plug from said at least one electrical plug outlet.

6. The wall outlet lock apparatus of claim 5 wherein said means for securing said face wall plate over said electrical wall outlet comprises at least one metallic screw.

7. The wall outlet lock apparatus of claim 5 wherein said first indicator light comprises a green indicator light.

8. The wall outlet lock apparatus of claim 5 wherein said second indicator light comprises a red indicator light.

* * * * *